US010393463B1

(12) United States Patent
Sanders et al.

(10) Patent No.: US 10,393,463 B1
(45) Date of Patent: Aug. 27, 2019

(54) SELF-TIGHTENING SUPPRESSOR MOUNT AND SYSTEM

(71) Applicant: OSS Suppressors LLC, Millcreek, UT (US)

(72) Inventors: David Sanders, Millcreek, UT (US); Richard Elder, Millcreek, UT (US)

(73) Assignee: OSS Suppressors LLC, Millcreek, UT (US)

( * ) Notice: Subject to any disclaimer, the term of this patent is extended or adjusted under 35 U.S.C. 154(b) by 0 days.

(21) Appl. No.: 16/100,007

(22) Filed: Aug. 9, 2018

Related U.S. Application Data

(60) Provisional application No. 62/652,091, filed on Apr. 3, 2018.

(51) Int. Cl.
*F41A 21/34* (2006.01)
*F41A 21/32* (2006.01)

(52) U.S. Cl.
CPC ..... *F41A 21/34* (2013.01); *F41A 21/325* (2013.01)

(58) Field of Classification Search
CPC ..... F41A 21/30; F41A 21/32; F41A 21/325; F41A 21/34; F41A 21/36; F41A 21/38
USPC ..... 89/14.3, 14.4; 42/1.06; 181/223
See application file for complete search history.

(56) References Cited

U.S. PATENT DOCUMENTS 2,143,596 A * 1/1939 Galliot ..... F41A 21/36 89/14.3
5,596,161 A 1/1997 Sommers
5,773,746 A * 6/1998 Vaden ..... F41A 21/325 181/223
6,722,254 B1 4/2004 Davies
7,905,171 B1 3/2011 Brittingham
8,387,299 B1 3/2013 Brittingham et al.
8,770,084 B2 7/2014 Young
8,820,473 B1 * 9/2014 White ..... F41A 21/34 181/223
9,188,403 B1 11/2015 White
9,207,033 B2 12/2015 Vais
(Continued)

OTHER PUBLICATIONS

Desert Tech; "Suppressors >> .338 DTSS"; Desert Tech Self-Tightening Silencer; [online]; (2016); [retrieved on Aug. 14, 2017]; 1 page; Retrieved from the internet: <URL: https://deserttech.com/suppressors/338-dtss.php>.
(Continued)

*Primary Examiner* — Bret Hayes
(74) *Attorney, Agent, or Firm* — Thorpe North & Western, LLP

(57) ABSTRACT

A firearm accessory system that self-tightens in response to firing comprises an interface structure (e.g., flash hider mount) threadably coupleable to a muzzle end of the firearm, and a suppressor threadably coupleable to the interface structure at a proximal end of the suppressor. At least one of the interface structure or the suppressor can comprise a plurality of discharge gas deflector openings formed at an angle relative to a central axis, and that exhaust discharge gases out through a distal end of the suppressor. In response to firing a projectile through the interface structure and the suppressor, discharge gases flowing through the plurality of discharge gas deflector openings cause a torsional force to tighten the respective one of the interface structure or the suppressor to the respective one of the muzzle end or the interface structure.

18 Claims, 9 Drawing Sheets

(56) References Cited

U.S. PATENT DOCUMENTS

| | | | | |
|---|---|---|---|---|
| 9,310,152 | B1* | 4/2016 | Poling | F41A 21/36 |
| 9,316,456 | B1 | 4/2016 | Oliver | |
| 9,441,900 | B1 | 9/2016 | Parrish | |
| 9,709,354 | B2 | 7/2017 | Larue | |
| 2010/0229713 | A1* | 9/2010 | Heath | F41A 21/34 89/14.2 |
| 2011/0036233 | A1* | 2/2011 | DeGroat | F41A 21/325 89/14.4 |
| 2012/0048100 | A1 | 3/2012 | Davies | |
| 2012/0167749 | A1* | 7/2012 | Young | F41A 21/30 89/14.3 |
| 2012/0279381 | A1 | 11/2012 | Landolt | |
| 2016/0161203 | A1* | 6/2016 | Wilson | F41A 21/30 89/14.3 |
| 2017/0067711 | A1 | 3/2017 | Slack | |
| 2018/0058789 | A1* | 3/2018 | Dome | F41A 21/30 |

OTHER PUBLICATIONS

Whoops; 'Re: Self Tightening Endcap?'; In: Silencer Talk Forum; (Mar. 15, 2017; 9:04 am UTC); 4 pages; [retrieved on Aug. 11, 2017]; Retrieved from the internet: <URL: http://www.silencertalk.com/forum/viewtopic.php?t=137931 >.

* cited by examiner

SELF-TIGHTENING SUPPRESSOR MOUNT AND SYSTEM

RELATED APPLICATION

This application claims priority to U.S. Provisional Application No. 62/652,091, filed Apr. 3, 2018 which is incorporated by reference.

BACKGROUND

Firearms can be used with a variety of accessories which can complement and enhance performance of the firearm for particular applications. Among the more common such firearm accessories include devices such as flash hiders and suppressors, which attach to a muzzle end of the firearm. The suppressor can include a wide variety of expansion chambers, baffles and structural features which dissipate and absorb energy to reduce acoustic report as a bullet exits the muzzle end of the firearm. Such an arrangement can require aligning the bullet passageway through the suppressor with the barrel of the firearm. Furthermore, it is highly desirable in many situations, such as tactical or combat situations, for the suppressor to be securely attached to the firearm, but also easily and rapidly removable from the muzzle end of the firearm (or from a flash hider attached to the muzzle end of the firearm). Various suppressor mount systems range from threaded mounts to numerous locking mechanisms. Many current devices involve the use of secondary tools to release the suppressor from the firearm, which can be time consuming and cumbersome, particularly during combat or law enforcement scenarios where fractions of a second can dramatically affect operator options and mission outcomes.

SUMMARY

In the present invention, it is desirable for the suppressor and/or the flash hider to self-tighten when the firearm is fired so that the suppressor and/or the flash hider do not become "loose" after multiple firings. There is a need for a suppressor that not only self-tightens upon firing, but that does not over-tighten after multiple successive firings, so that it is quickly and easily removable by hand without the use of tools, and without the operation of complex or cumbersome locking mechanisms.

Accordingly, a firearm accessory system and associated methods are provided. Such a firearm accessory system, coupleable to a firearm and that self-tightens in response to firing a projectile, can comprise an interface structure threadably coupleable to a muzzle end of the firearm. The interface structure can have a central axis that corresponds to a projectile pathway. The firearm accessory system can comprise a suppressor threadably coupleable to the interface structure at a proximal end of the suppressor. At least one of the interface structure or the suppressor can comprise a plurality of discharge gas deflector openings. Discharge gas deflector openings are separate from a boreline opening through which the projectile passes. Each discharge gas deflector opening can also be formed at an angle relative to the central axis and to exhaust discharge gases out through a distal end of the suppressor. Therefore, in response to firing a projectile through the interface structure and the suppressor, discharge gases flowing through the plurality of discharge gas deflector openings cause a torsional force to tighten the respective one of the interface structure or the suppressor to the respective one of the muzzle end or the interface structure.

In one example, the plurality of discharge gas deflector openings can comprise a first plurality of discharge gas deflector openings and a second plurality of discharge gas deflector openings. The interface structure can comprise the first plurality of discharge gas deflector openings each formed at a first angle relative to the central axis, and the suppressor can comprise the second plurality of discharge gas deflector openings each formed at a second angle relative to the central axis. In one example, the first angle is different from the second angle.

In one example, the first plurality of discharge gas deflector openings can be formed to cause a first torsional force to tighten the interface structure to the muzzle end in a first direction. And the second plurality of discharge gas deflector openings can be formed to cause a second torsional force to tighten the suppressor to the interface structure in a second direction. In one example, the first direction is opposite from the second direction.

In one example, the plurality of discharge gas deflector openings can comprise a plurality of half-channels arranged in a helical manner about a peripheral area of the distal end of the suppressor. The plurality of half-channels can be arranged to surround a longitudinal central axis of the suppressor.

In one example, the plurality of half-channels can surround a primary exhaust opening of the suppressor formed through the distal end of the suppressor.

In one example, the plurality of half-channels can each comprise a lead angle formed at an angle relative to the central axis. The suppressor can comprise right-handed threads operable to be right-hand threadably engaged to left-hand threads of the interface structure. Discharge gases flowing through the plurality of half-channels can cause a counter-clockwise torsional force to tighten the suppressor in a counter-clockwise direction to the interface structure about the right-handed threads and the left-handed threads.

In one example, the plurality of half-channels can be formed to exhaust secondary exhaust gases radially through the distal end of the suppressor, and the primary exhaust opening can be formed separate from the plurality of half-channels such that the primary exhaust opening exhausts primary exhaust gases generally axially out the primary exhaust opening.

In one example, the plurality of discharge gas deflector openings can be tuned to a size and shape such that the torsional force does not exceed a hand removal torque threshold associated with removing the suppressor from the interface structure. In one example, the hand removal torque threshold can be 30 ft-lbs, and in some cases 20 ft-lbs, and often about 15 ft-lbs.

In one example, the suppressor can include a segregated gas pathway defined by central deflectors. The segregated pathway leads to the plurality of discharge gas deflector openings, and the segregated gas pathway can be defined over at least 50 percent of a length of the suppressor.

In one example, the plurality of discharge gas deflector openings can comprise a plurality of internal deflectors formed about an inner chamber area of the suppressor.

In one example, the plurality of discharge gas deflector openings can comprise a plurality of angled slots formed through an outer surface portion of the interface structure. The plurality of angled slots can be situated around a longitudinal central axis of the suppressor.

In one example, the plurality of angled slots can comprise a first set of angled slots and a second set of angled slots axially off-set from each other along the central axis of the interface structure.

In one example, the suppressor comprises a plurality of complimentary angled slots formed at locations that correspond to the plurality of angled slots of the interface structure.

In one example, the suppressor comprises a first tapered annular surface interfaceable to a second tapered annular surface of the interface structure to form a seal interface between the interface structure and the suppressor to minimize or eliminate an amount of exhaust particles collectable between the interface structure and the suppressor.

The present disclosure sets forth a firearm accessory system, coupleable to a firearm and that self-tightens in response to firing, that can comprise an interface structure threadably coupleable to a muzzle end of a firearm. The interface structure can have a central axis that corresponds to a projectile pathway. The interface structure can comprise a first plurality of discharge gas deflector openings each formed at a first angle relative to the central axis and to facilitate passage of discharge gases. The firearm accessory system can comprise a suppressor threadably coupleable to the interface structure at a proximal end of the suppressor. The suppressor can comprise a second plurality of discharge gas deflector openings each formed at a second angle relative to the central axis and to exhaust discharge gases out through a distal end of the suppressor. Upon firing a projectile through the interface structure and the suppressor, discharge gases flowing through the first plurality of discharge gas deflector openings can cause a first torsional force to tighten the interface structure to the muzzle end of the firearm, and discharge gases exhausting through the second plurality of discharge gas deflector openings can cause a second torsional force to tighten the suppressor to the interface structure.

In one example, the first plurality of discharge gas deflector openings can be formed at the first angle to cause a first torsional force to tighten the interface structure to the muzzle end in a first direction. The second plurality of discharge gas deflector openings can be formed at the second angle to cause a second torsional force to tighten the suppressor to the interface structure in a second direction. In one example, the first angle is transverse relative to the second angle, and the first direction is opposite from the second direction.

In one example, the plurality of discharge gas deflector openings can comprise a plurality of half-channels arranged in a helical manner about a peripheral area of the distal end of the suppressor. The plurality of half-channels can be arranged to surround a longitudinal central axis of the suppressor. The plurality of half-channels can surround a primary exhaust opening of the suppressor formed at the distal end of the suppressor. The suppressor can comprise right-handed threads operable to be right-hand threadably engaged to left-hand threads of the interface structure. Discharge gases flowing through the plurality of half-channels can cause a counter-clockwise torsional force to tighten the suppressor in a counter-clockwise direction to the interface structure about the right-handed threads and the left-handed threads.

In one example, the second plurality of discharge gas deflector openings can be tuned to a size and shape such that the torsional force does not exceed a hand removal torque threshold. The suppressor can be devoid of a locking device such that the suppressor is removal by hand from the interface structure.

In one example, the first plurality of discharge gas deflector openings comprises a plurality of angled slots formed through an outer surface portion of the interface structure. The plurality of angled slots can be situated around a longitudinal central axis of the suppressor, and the plurality of angled slots can be formed in an opposite direction relative to the second plurality of discharge gas deflector openings of the suppressor.

The present disclosure sets forth a method of removing the suppressor from an interface structure comprising firing a plurality of projectiles from the firearm through the interface structure and the suppressor. In response to firing at least one projectile, the suppressor self-tightens to the interface structure due to the torsional force exerted by exhaust gases exiting the plurality of discharge gas deflector openings. The method can comprise rotating the suppressor relative to the interface structure with at least one hand of a user to remove the suppressor from the interface structure, such that removal of the suppressor from the interface structure is achieved without operating a locking mechanism.

This summary is provided as a general overview of essential and optional features of the invention and should in no way be construed to limit the appended claims beyond those claim terms which are expressly outlined.

Figure 1:
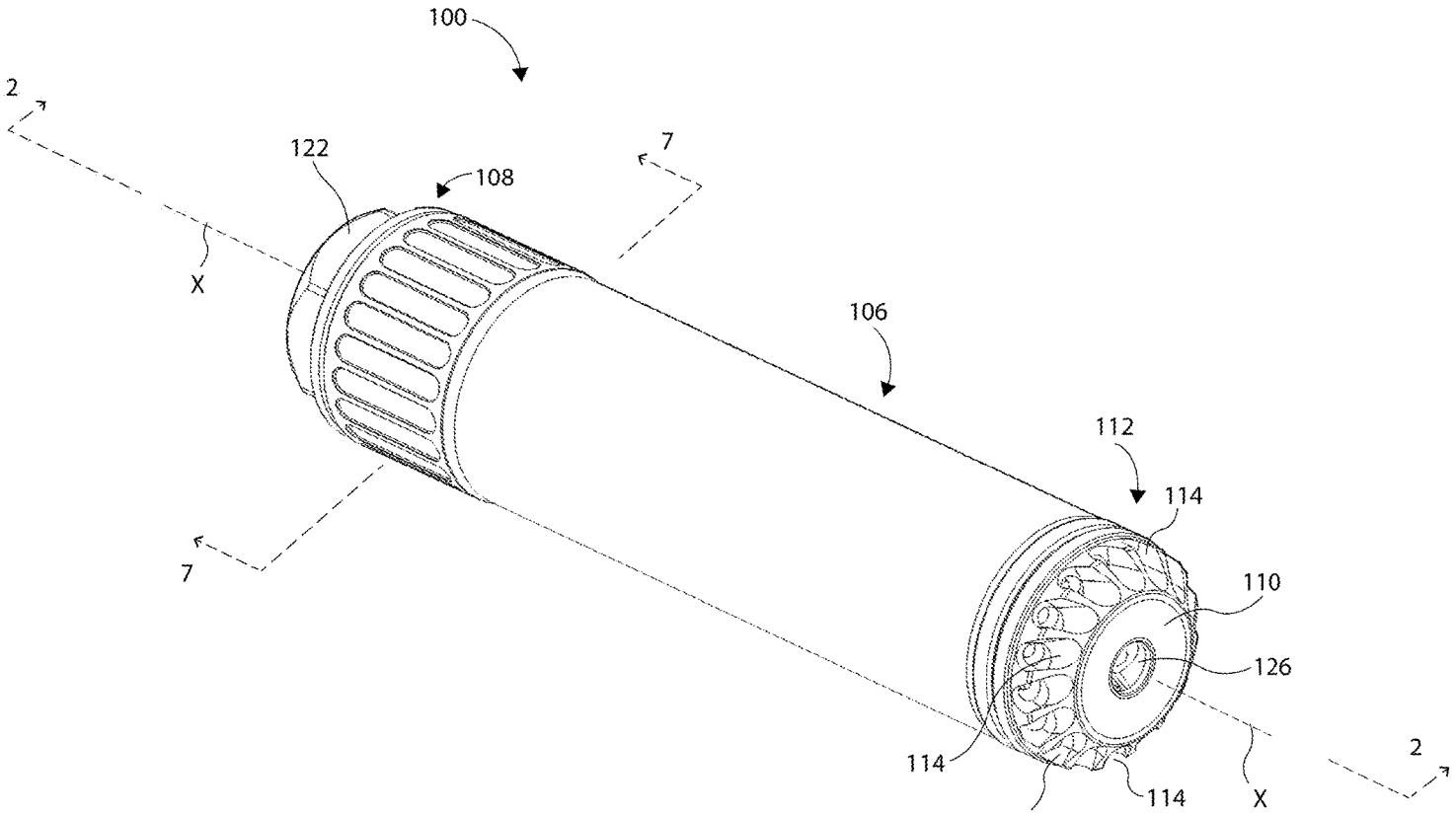
FIG. 1 is a perspective view of a firearm accessory system in accordance with an example of the present disclosure.

These figures are provided merely for convenience in describing specific embodiments of the invention. Alteration in dimension, materials, and the like, including substitution, elimination, or addition of components can also be made consistent with the following description and associated claims. Reference will now be made to the exemplary embodiments illustrated, and specific language will be used herein to describe the same. It will nevertheless be understood that no limitation of the scope of the invention is thereby intended.

DETAILED DESCRIPTION

Reference will now be made to certain examples, and specific language will be used herein to describe the same. Examples discussed herein set forth a firearm discharge gas flow control device and associated methods that can modify flow of the gas discharged by firing a projectile from a firearm.

With the general embodiments set forth above, it is noted that when describing the firearm discharge gas flow control device, or the related method, each of these descriptions are considered applicable to the other, whether or not they are explicitly discussed in the context of that embodiment. For example, in discussing the manufactured home transportation device per se, the system and/or method embodiments are also included in such discussions, and vice versa.

It is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "a wall" includes one or more of such walls.

As used herein, the term "about" is used to provide flexibility and imprecision associated with a given term, metric or value. The degree of flexibility for a particular variable can be readily determined by one skilled in the art. However, unless otherwise enunciated, the term "about" generally connotes flexibility of less than 5%, and most often less than 1%, and in some cases less than 0.01%.

As used herein, the term "at least one of" is intended to be synonymous with "one or more of." For example, "at least one of A, B and C" explicitly includes only A, only B, only C, and combinations of each.

Also, it is noted that various modifications and combinations can be derived from the present disclosure and illustrations, and as such, the following figures should not be considered limiting.

In describing and claiming the present invention, the following terminology will be used in accordance with the definitions set forth below.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims unless otherwise stated. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

As used herein the term "suppressor" includes any device that reduces the amount of noise and/or muzzle flash generated by firing a firearm.

FIGS. 1-9 show various views and aspects of a firearm accessory system 100 in accordance with an example of the present disclosure. As an overview, the firearm accessory system 100 is configured and designed such that, in response to or during firing a projectile through the firearm accessory system 100, the system self-tightens to reduce or prevent the firearm accessory system 100 (and components thereof) from becoming loose, but does not overtighten to a point that a user cannot remove the firearm accessory system 100 from the firearm it is attached to. Thus, the firearm accessory system 100 can be easily and rapidly attached to the firearm by hand (and without the use of a locking or retention mechanism operated by the user), and then projectile(s) can be fired through the firearm accessory system 100 to facilitate said self-tightening. Then, the firearm accessory system 100 can be rotated and removed from the firearm by hand without tools or other devices, because the firearm accessory system 100 is designed so that it will not overtighten to the firearm (or to a flash hider attached to the firearm). In prior systems, tools or other devices are typically required to remove a suppressor from a firearm, because a user cannot merely rotate the suppressor to remove it from the firearm, whether because it is too tight or because a locking mechanism must be operated to unlock and remove the suppressor from the firearm.

More specifically, and with particular reference to FIGS. 2-5, the firearm accessory system 100 can comprise an interface structure 102 threadably coupleable to a muzzle end of a firearm (not shown). The interface structure 102 can be left-handed threadably coupleable to the muzzle end, and can be configured as a suppressor mount and as a flash hider which can remain in place during unsuppressed firing (i.e., when a suppressor is removed from the interface structure 102). The interface structure 102 can have a central axis X that extends longitudinally through the interface structure 102 about a centroid of the interface structure 102. The central axis X corresponds to a projectile pathway P, which is the boreline pathway traversing the firearm accessory system 100 through which a bullet or projectile travels. The interface structure 102 can comprise a first plurality of discharge gas deflector openings 104 each formed at a first lead angle A1 (see FIGS. 6 and 7) relative to a radial ray from the central axis X to facilitate self-tightening of the interface structure 102 to the muzzle end of the firearm, as further detailed below.

Figure 2:
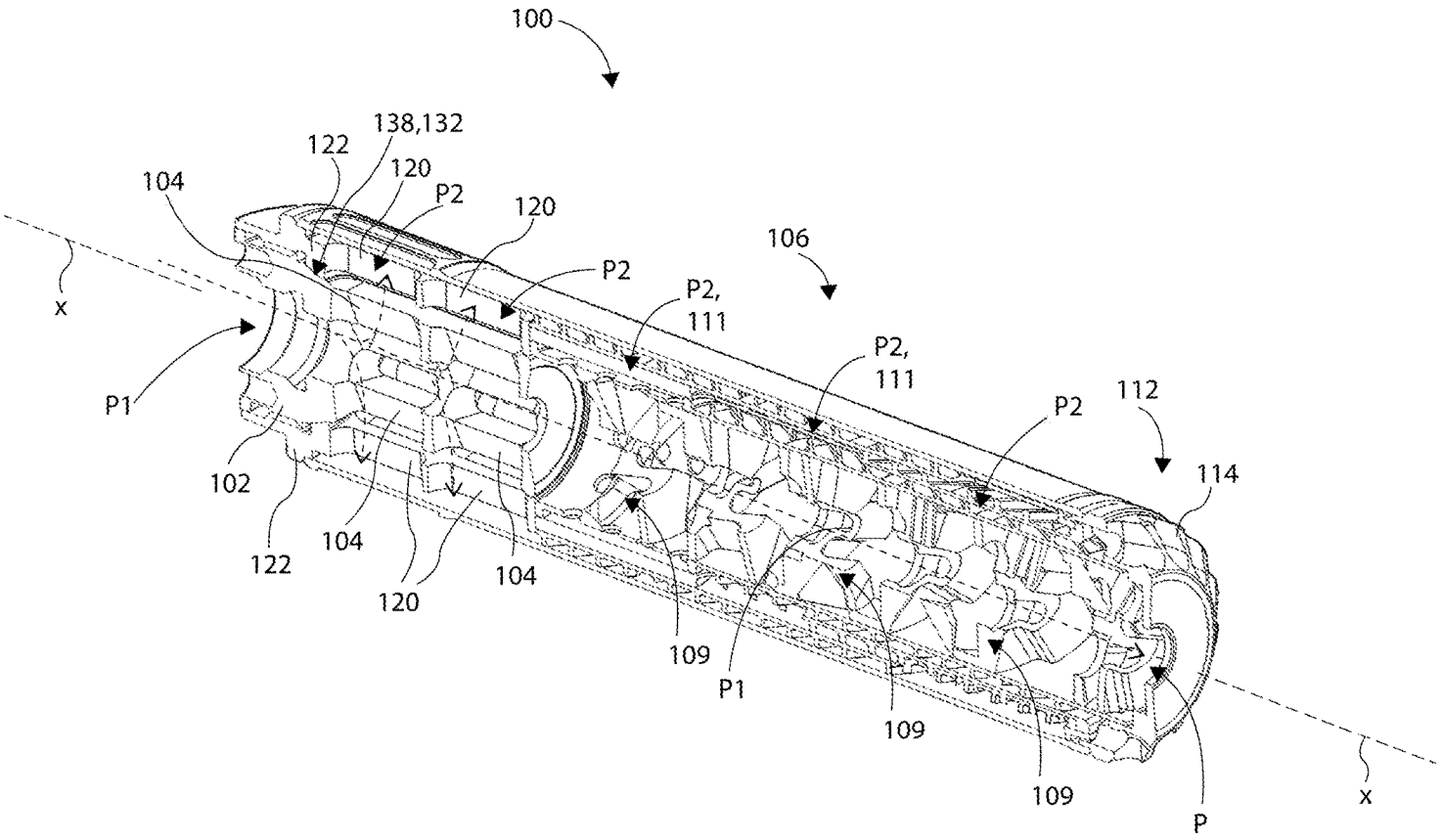
FIG. 2 is a cross sectional view of the firearm accessory system in FIG. 1, and taken along lines 2-2.

The firearm accessory system 100 can comprise a suppressor 106 threadably coupleable to the interface structure 102 at a proximal end 108 of the suppressor 106. The suppressor 106 can be right-handed threadably coupleable to the interface structure 102. The suppressor 106 can further define the central axis X that corresponds to the projectile pathway P discussed above. The suppressor 106 can include a number of baffles, discharge gas deflectors, housings, and other components shown in FIGS. 2 and 4, in one example, and will not be labelled or discussed in detail. A wide variety of baffles and internal chambers can be used in connection with the suppressor 106 of the firearm accessory system 100 and are not particularly limited. However, exemplary suppressor chamber configurations are more fully described herein and in U.S. Pat. No. 9,316,456, which is incorporated herein by reference in its entirety. Other components, as shown in FIG. 2 (and others) of the suppressor 106, are more fully described in U.S. application Ser. No. 15/000,985, filed Jan. 19, 2016 which is also incorporated herein by reference in its entirety.

The suppressor 106 can further comprise a suppressor cap portion 110 coupled about a distal end 112 of the suppressor 106 (see FIGS. 1, 5, 8, and 9). Alternatively, the suppressor cap portion 110 can be formed integral with a housing or body (or other portion) of the suppressor 106. In either configuration, the suppressor cap portion 110 can comprise a second plurality of discharge gas deflector openings 114 each formed at a second lead angle A2 (FIG. 8) relative to the central axis X to facilitate self-tightening of the suppressor 106 to the interface structure 102 when discharge gases are discharged out of the second plurality of discharge gas deflector openings 114, as further detailed below.

Accordingly, when a projectile is fired through the interface structure 102 and the suppressor 106, discharge gases flowing through the first plurality of discharge gas deflector openings 104 can cause a first torsional force F1 to tighten the interface structure 102 to the muzzle end of the firearm, and discharge gases exhausting through the second plurality of discharge gas deflector openings 114 can cause a second torsional force F2 to tighten the suppressor 106 to the interface structure 102 in an opposite direction than that of the interface structure 102 being self-tightened to the firearm. The details of this are further described below.

Figure 3:
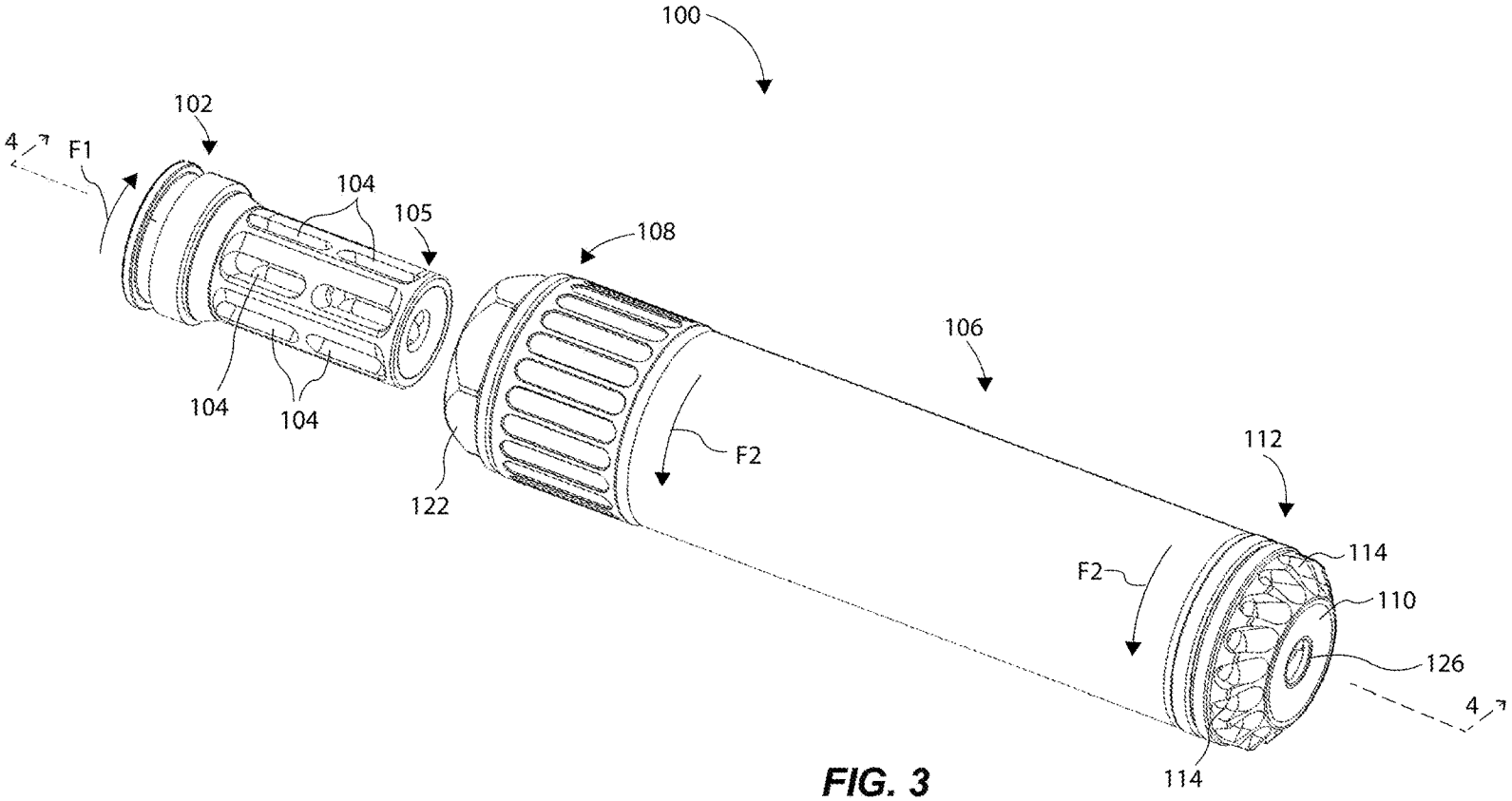
FIG. 3 is a partially exploded perspective view of the firearm accessory system in FIG. 1.
Figure 6:
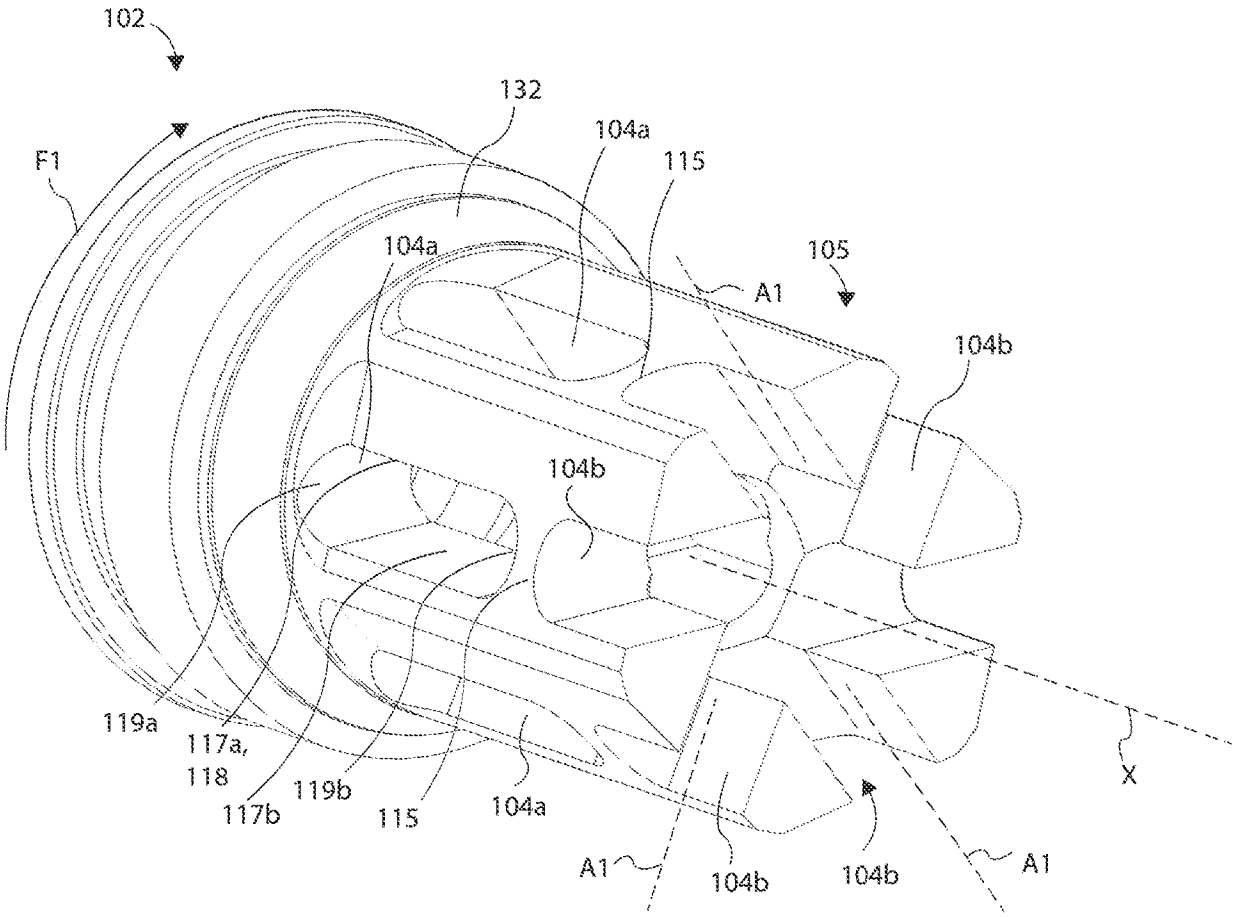
FIG. 6 is a perspective cross sectional view of the interface structure in FIG. 5, and taken along lines 6-6.
Figure 7:
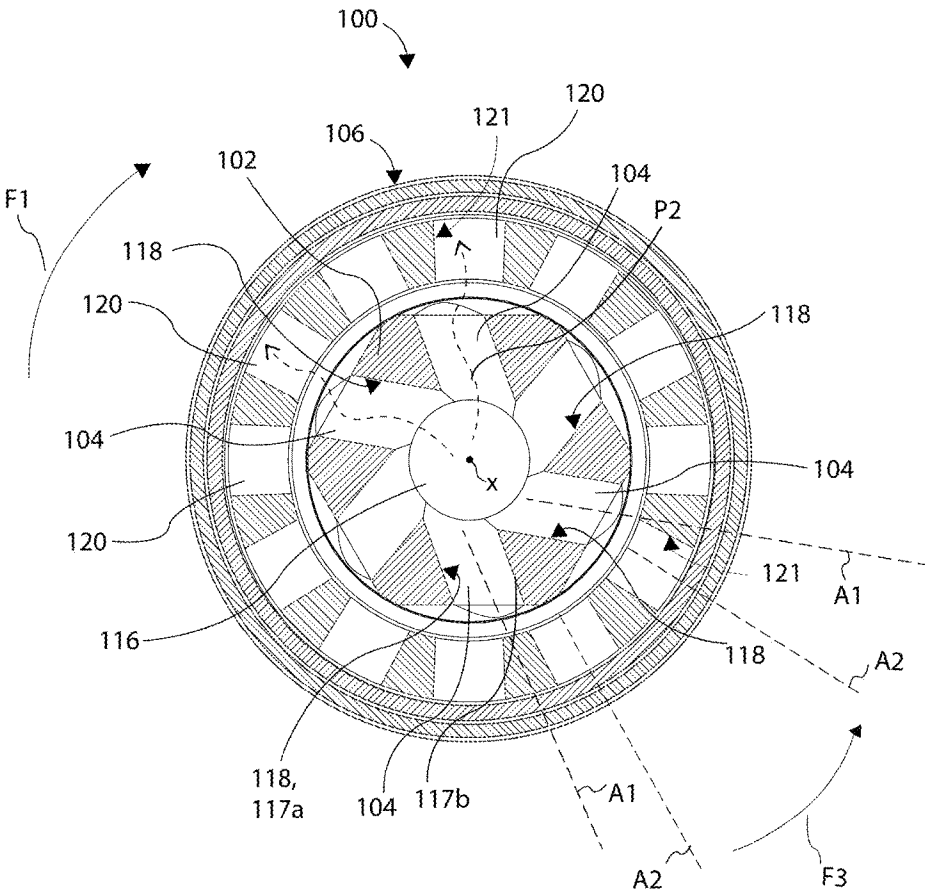
FIG. 7 is a cross sectional view of the firearm accessory system in FIG. 2, and taken along lines 7-7.

More specifically, as introduced above the first plurality of discharge gas deflector openings 104 can be formed at the first lead angle A1 such that pressure from discharge gases cause a clockwise rotational or torsional force F1 to the interface structure 102 to self-tighten it to the muzzle end of the firearm, as illustrated in FIGS. 3 and 6. That is, right-handed threads of the interface structure 102 will automatically or self-tighten to left-handed threads of the muzzle end (e.g., up to a maximum torque threshold) during firing of one or more projectiles, because the first plurality of discharge gas deflector openings 104 are each formed at an angle or a slant formed in a left-handed off-set manner relative to a central projectile opening 116 of the interface structure 102. This is illustrated by the cross-sectional view of FIG. 7, showing the openings 104 formed at an angle or slant relative to the central projectile opening 116 through which the projectile travels. In this manner, pressure from discharge gases tend to bias or exert a radial outward force against deflector walls 118 of each of the first plurality of discharge gas deflector openings 104 so that an overall gas pressure force is exerted about the deflector walls 118 in a uniform manner. Such gas pressure cause the clockwise torsional force F1 to the interface structure 102 onto the muzzle end of the firearm so that the interface structure 102 can be radially uniformly self-threaded to the muzzle end (i.e., the radial uniform threading in this manner can prevent binding of the threads of the interface structure 102 and the threads of the muzzle end).

As shown in FIGS. 3-6, the interface structure 102 can comprise a first set of discharge gas deflector openings 104*a* (FIG. 4) formed radially around a body 105 of the interface structure 102, and a second set of discharge gas deflector openings 104*b* that as similarly formed as the first set of discharge gas deflector openings 104*a*. Note that FIG. 4 includes labels for the first and second sets of openings 104*a* and 104*b* that collectively define the first plurality of discharge gas deflector openings 104, as labeled in other drawings. The first and second sets of openings 104*a* and 104*b* are axially off-set from each other along the central axis X and separated by sidewalls 115 (FIG. 6), and can be formed as elongate slots that, together, can comprise more than 50 percent of a length of the interface structure. In this configuration, a relatively large volume of discharge gases can traverse through the first and second set of openings 104*a* and 104*b* prior to entering the baffles, primary, secondary off-axis chambers, or central chambers of the suppressor 106 down the boreline. In another example, the first plurality of discharge gas deflector openings 104 can be formed as a number of smaller openings, such as smaller circular openings defining multiple sets of openings arrayed around the interface structure 102.

As further illustrated in FIGS. 6 and 7, each opening 104 can be defined by opposing first and second sidewalls 117*a* and 117*b* (e.g., opening 104*a* of FIG. 6), where the first sidewall 117*a* can define the deflector wall 118. The first and second sidewalls 117*a* and 117*b* are formed generally parallel to each other, and can each be formed at the lead angle A1 relative to the central axis X, as discussed above. The first and second sidewalls 117*a* and 117*b* can be joined by arced end walls 119*a* and 119*b* (FIG. 6), thereby forming an angled or slanted slot configuration. Other shapes are contemplated herein, such as circular holes, rectangular slots, polygon shaped openings, etc.

Figure 4:
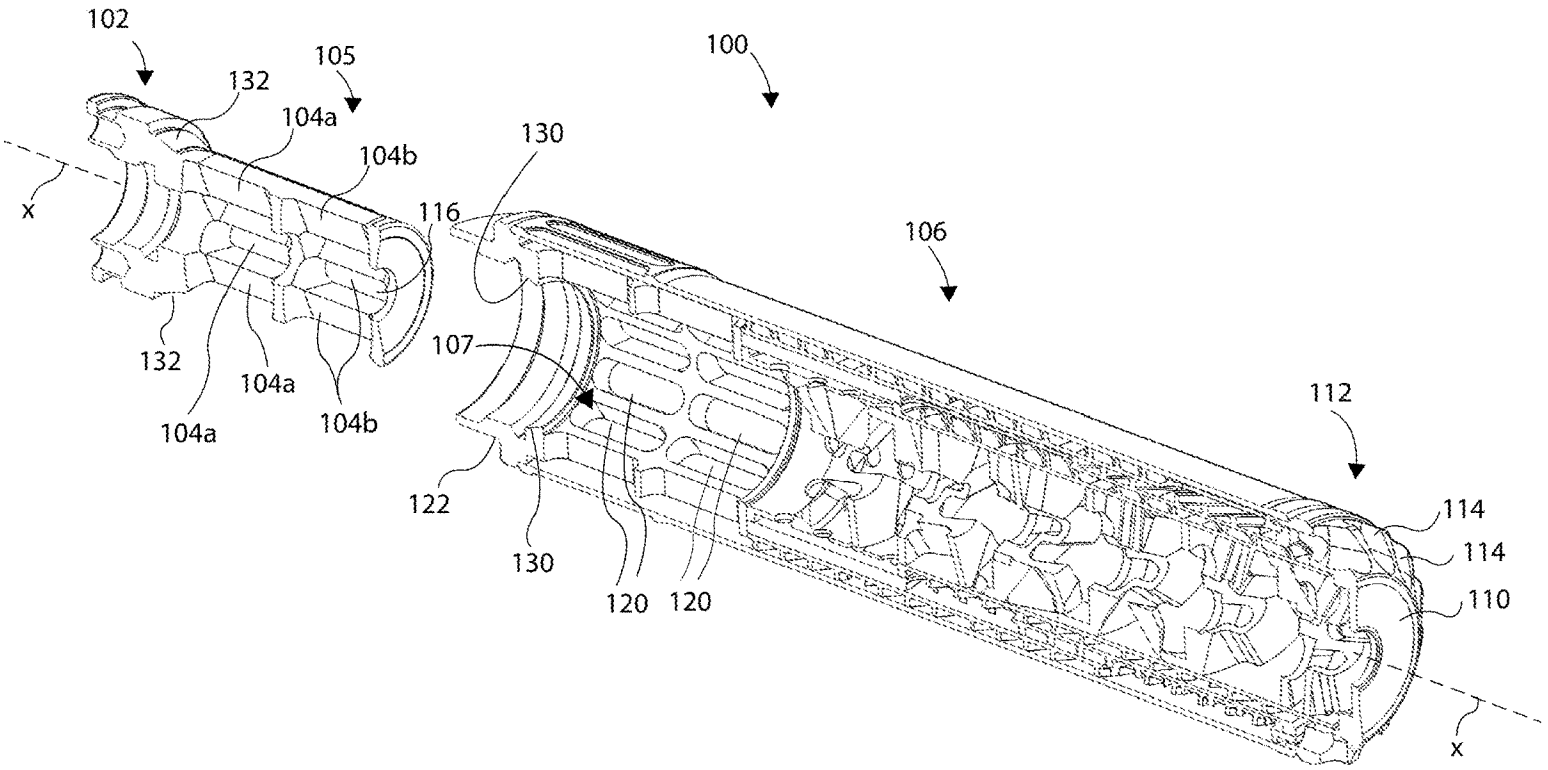
FIG. 4 is a cross sectional view of the firearm accessory system in FIG. 3, and taken along lines 4-4.

As further shown in FIG. 2, the first plurality of discharge gas deflector openings 104 (including the first and second sets of openings 104*a* and 104*b*) can comprise or define a plurality of gas deflectors that are disposed about a proximal inner chamber area 107 defined by the suppressor 106 (see FIG. 4). Notably, the first plurality of discharge gas deflector openings 104 can be radially disposed about or proximate the proximal end 108 of the suppressor 106. This provides an initial pathway for discharge gases to travel through the first plurality of discharge gas deflector openings 104 near the proximal end 108, so that as much volume of discharge gases as possible or feasible can be re-directed away from a primary pathway P1 to a segregated gas pathway P2 (discussed below). This slows down some volume of the gases exiting out the suppressor 106, which further suppresses the full amount of discharge gases exiting from the suppressor 106.

As shown in FIG. 7, discharge gases can flow axially through the central projectile boreline opening 116 of the interface structure 102, then radially through the first plurality of discharge gas deflector openings 104, and then radially through outer radial openings 120 of a deflector body 122 of the suppressor 106, and then axially to an outer chamber 111 (FIG. 2) of the suppressor 106. Note that such outer chamber 111 (and other outer chambers defined by outer deflectors of the suppressor 106) may define the segregated gas pathway P2 (FIG. 2) for exhaust of gases that eventually flow out of the second plurality of discharge gas deflector openings 114 of the suppressor end portion 110, while the primary pathway P1 extends through a central area of the suppressor 106 through baffles 109, as shown in FIG. 2. Notably, as explained above, gases impinging on deflector walls 118 create a torsional force F1 in a clockwise direction which tightens the interface structure 102 onto a barrel. As those gases then exit deflector openings 104, the gases impinge on surface 121 within outer radial openings 120. These radial openings can be angled at a lead angle A2 which is less than A1. In some cases, A2 can be a lead angle which is opposite to A1 (e.g. as measured from a radial ray from axis x) in direction. More specifically, If A1 is defined as positive (e.g. 10-40°), then A2 would be negative (e.g. negative 5-40°). As a general guideline, P2 can impinge on rightward walls (e.g. 118) of exit deflector openings at angle A1, and subsequently impinge on opposite leftward walls (e.g. 121) of outer radial openings 120. In this manner, an opposite counter-clockwise torsional force F3 is applied to the suppressor 106. In one example, the segregated gas pathway P2 can be defined over at least 50% of a length of the suppressor 106, and in some cases at least 66% of the length. In one example, the segregated gas pathway P2 may be defined by a straight, hollow chamber such that exhaust gases are not re-directed, and rather go straight from the outer radial openings 120 to the second plurality of discharge gas deflector openings 114.

Figure 8:
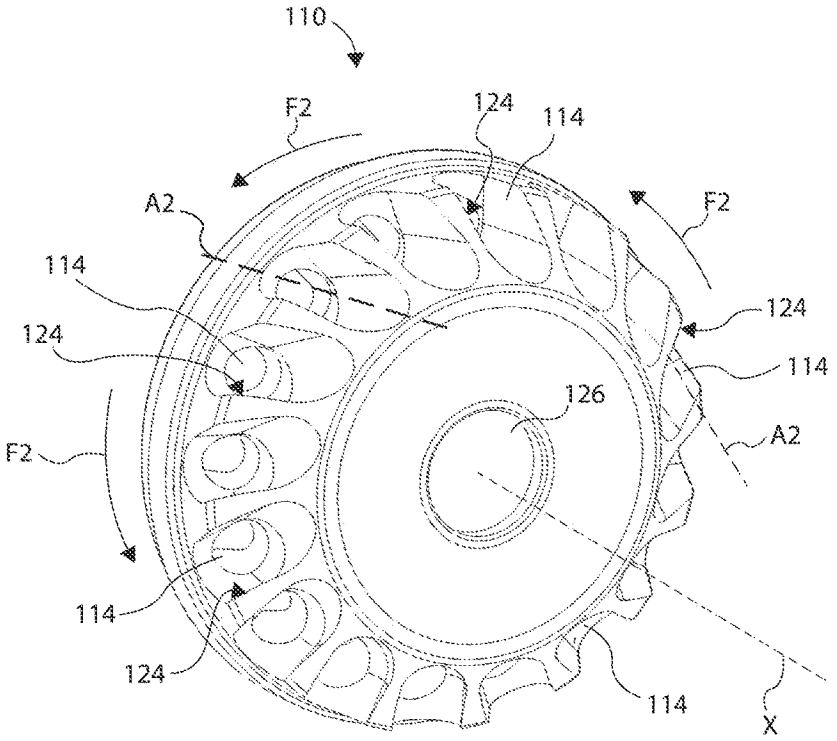
FIG. 8 is an perspective view of a suppressor end portion of the suppressor in FIG. 5.
Figure 9:
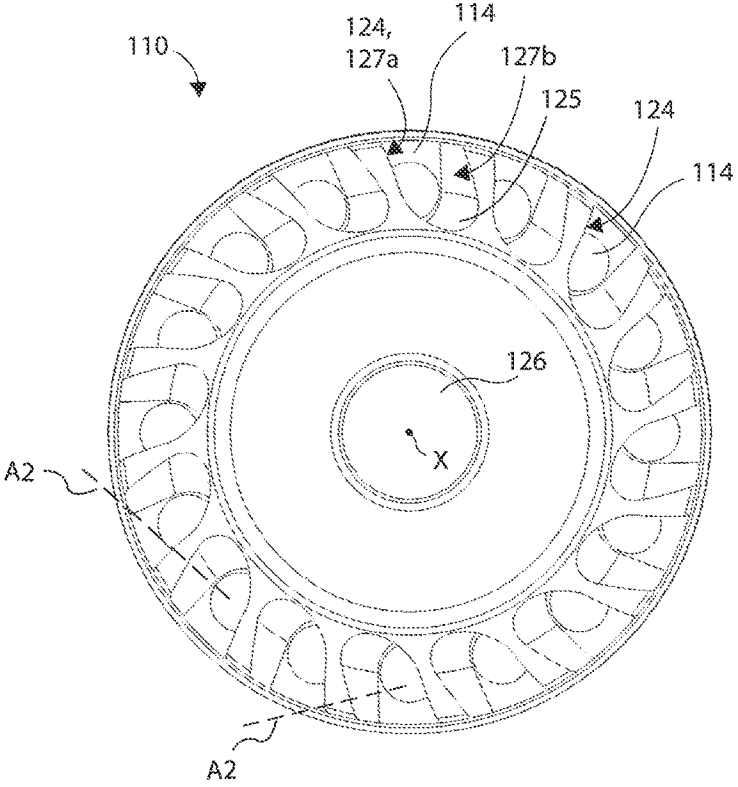
FIG. 9 is a front view of the suppressor end portion of the suppressor in FIG. 8.

Similarly (but inversely) to formation of the first plurality of discharge gas deflector openings 104, the second plurality of discharge gas deflector openings 114 of the suppressor end portion 110 can be formed at the second lead angle A2, as illustrated in FIGS. 8 and 9, such that discharge gases exit radially and at an angle through the second plurality of discharge gas deflector openings 114 relative to the central axis X. Such gas pressure, and direction of flow of the discharge gases, cause a counter-clockwise rotational or torsional force F2 (i.e., opposite the direction of force F1) to the suppressor 106 to self-tighten it to the interface structure 102, as illustrated in FIGS. 3 and 6 with the directional arrows indicating rotational direction of force. That is, right-handed threads of the suppressor 106 will self-tighten to left-handed threads of the interface structure 102 during firing of one or more projectiles, because the second plurality of discharge gas deflector openings 114 are each formed at an angled slot (or a slant or leading edge) that is formed in a right-handed off-set manner relative to the central axis X, as illustrated in FIG. 8. In this manner, discharge gases tend to bias against deflector walls 124 of each of the openings 114, thereby exerting the counter-clockwise torsional force F2 to the suppressor end portion 110 of the suppressor 106 relative to the interface structure 102. Said another way, the second plurality of discharge gas deflector openings 114 are formed in an opposite radial direction that the first plurality of discharge gas deflector openings 104, so that discharge gases can simultaneously (or almost simultaneously within a few tenths of a second) cause tightening of the interface structure 102 to the muzzle end, and tightening of the suppressor 106 to the interface structure 102.

In one example, the second plurality of discharge gas deflector openings 114 can comprise a plurality of half-channels arranged in a helical manner about a peripheral area of the distal end 112 of the suppressor 106. These half-channels are partially open channels having an inner wall 125 (FIG. 9), two opposing left and right walls 127*a* and 127*b*, and an outer wall 129. The left wall 127*a* can define the aforementioned deflector wall 124 against which exhaust gases are expelled to cause torsional force F2. The inner wall 125 is oriented radially inward of the outer wall 129 such that the inner wall 125 has a larger height than a corresponding height of the outer wall 129. Similarly, the left and right walls 127*a* and 127*b* are spaced circumferentially and have a height intermediate that of the inner and outer walls 125 and 129. These left and right walls 127*a* and 127*b* are generally inclined at a common angle (i.e., A2) as described herein. Thus, these half-channels form canted exhaust ports with torque-producing impact surfaces (i.e., primarily the deflector walls 124).

The plurality of half-channels can be arranged to surround the longitudinal central axis X of the suppressor 106. The plurality of half-channels can surround a primary exhaust opening 126 (where a bullet exits) of the suppressor 106. In this manner, primary discharge gases can exit axially out the primary exhaust opening 126, while secondary discharge gases can exit radially out the second plurality of discharge gas deflector openings 114 of the suppressor end portion 110. Because the secondary discharge gases are initially re-directed through the first plurality of discharge gas openings 104, and then traverse back and forth about the segregated gas pathway P2, the secondary discharge gases can move "slower" (e.g. traverse a longer exit pathway) than the primary exhaust gases that are discharged through the primary exhaust opening 126. Thus, the secondary discharge gases are somewhat delayed, which further suppresses discharge gases from the suppressor 106. Thus, the suppressor 106 has more than one discharge gas opening at the distal end 112 of the suppressor 106, as compared to prior suppressors that only have one discharge gas opening for exhausting gases (i.e., the opening where the bullet exits).

Figure 5:
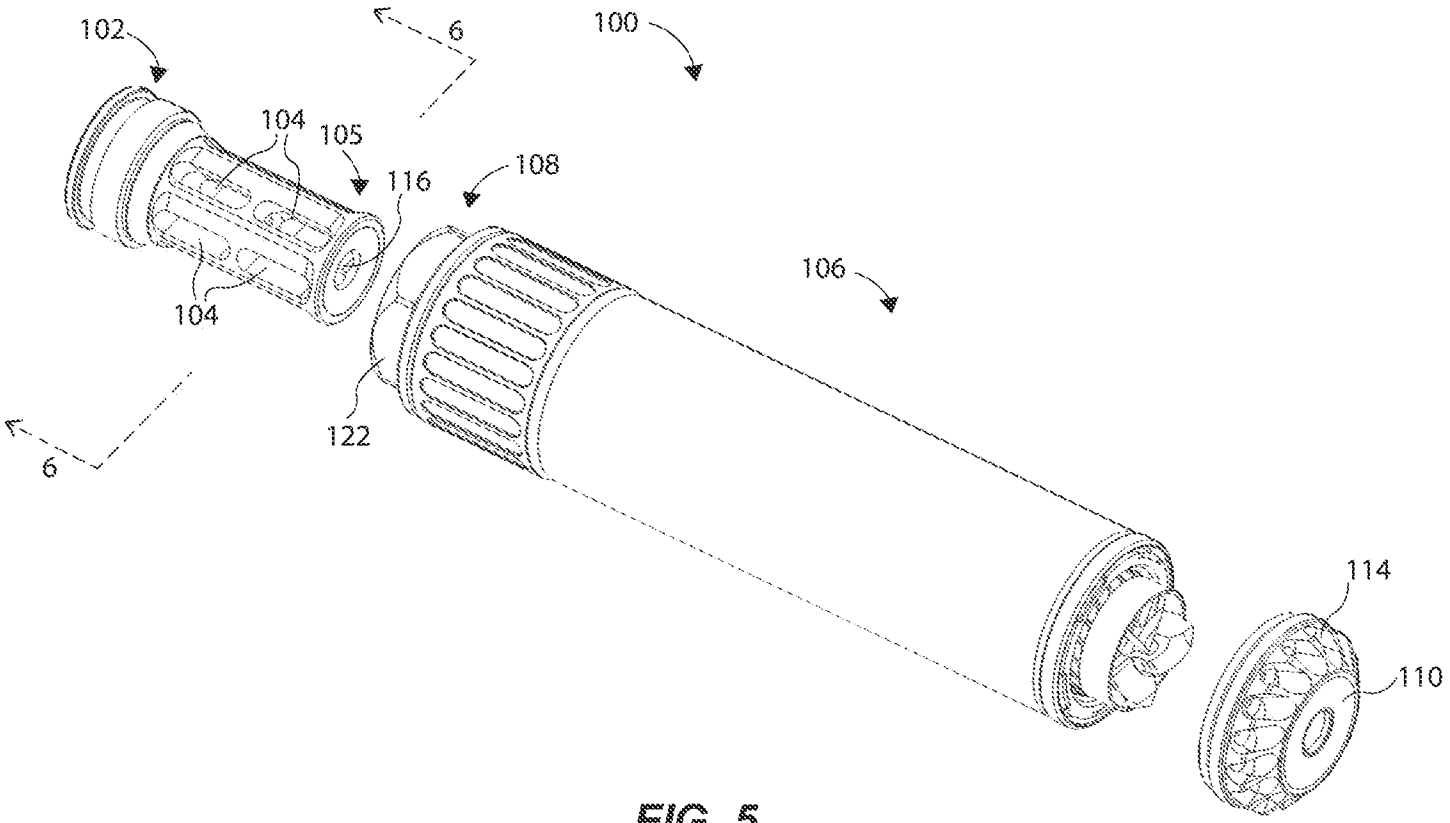
FIG. 5 is an exploded perspective view of the firearm accessory system in FIG. 1.

In one example, the suppressor 106 can comprise right-handed threads that can be right-hand threadably engaged to left-hand threads of the interface structure 102. This can be achieved by a direct contact between the deflector body 122 (of the suppressor 106) and the interface structure 102, such as shown in FIGS. 2 and 5. This "right-hand and left-hand thread coupling interface" between the suppressor 106 and the interface structure 102 is particularly advantageous because, when a projectile is fired through the suppressor, a compression force is exerted outwardly away from the firearm, which tends to axially "push" the suppressor 106 away from the interface structure 102. However, because the suppressor 106 is right-handed threadably engaged to the interface structure 102, such compression force is counteracted because of the right-handed threads tending to resist against such compression force. This helps to prevent or reduce the likelihood of the suppressor 106 from loosening from the interface structure 102.

Notably, there are at least primary torque producing forces which contribute to forces F1, F2 and F3. Specifically, discharge gases impinging upon angled surfaces within either or both of the interface structure 102 and the suppressor 106 will create torsion forces. In another aspect, having force F1 opposite of force F2 and F3 allows for the suppressor 106 to be removed without inadvertently also loosening the interface structure 102 (e.g., suppressor mount). Although exemplified with force F1 as clockwise and force F2/F3 as counterclockwise, the corresponding threads can be reversed as long as they are opposite one another.

Furthermore, each threaded interface can be viewed as an inclined plane. Upon discharge, the suppressor 106 can experience rearward momentum which translates into incline motion in a rearward direction along the threads, thus causing tightening of the threaded interface. This rearward motion also temporarily compresses complimentary thread surfaces against one another to reduce passage of gasses through the threads. Such sealing compression further reduces buildup of carbon and debris which can undesirably lock-up the threaded engagement. In some cases, the sealing compression substantially eliminates gas passage during discharge sufficient to substantially eliminate carbon buildup within the threads. One contributing factor to such active sealing compression is forming a suppressor body 122 base having a longitudinal length which bottoms out in front of corresponding threads on the interface structure 102. More specifically, leaving a gap between a proximal end of the suppressor body 122 and a base portion of the interface structure allows relative motion as described above (e.g. incline motion) with each discharge of a projectile. Thus, in most cases, the incline motion is reversed to allow for minor expansion and return to an original pre-discharge relative position of the interface structure 102 and suppressor body 122.

Notably, the second plurality of discharge gas deflector openings 114 (including other walls within the suppressor 106) can be tuned to a size and shape such that the torsional force F2 plus F3 does not exceed a hand removal torque threshold (e.g., 30 ft-lbs. or less). By being "tuned" this can mean that a number of factors or variables are considered when forming the second plurality of discharge gas deflector openings 114, so that any one application of the torsional force F2 (from firing a single projectile), or that any collective application of torsional forces F2 and F3 (from firing multiple/successive projectiles), does not cause too great of a self-tightening torsional force so that a user cannot unthread the suppressor 106 from the interface structure 102 (or from a muzzle end, as the case may be) without using a secondary tool (e.g., hand removable). Such factors or variables to tune the suppressor end portion 110 can include: the position, amount, size of the openings 114; the angle of the openings relative to the central axis X; the type of firearm it is attached to; the caliber of projectile fired through the suppressor; and the timing of discharge gases exiting the openings; the velocity of discharge gases once the gases exit the openings 114; size, number and angles of intervening walls throughout the suppressor; and the like. While this discussion focuses largely on exit openings 114 in determining torque production, other baffles, deflector walls, and features throughout the suppressor assembly can contribute to the production and tuning of applied torque. Similar factors or variables can be taken into consideration when forming the first plurality of discharge gas deflector openings 104 of the interface structure 102.

Therefore, regardless of, or independent of, the number of projectiles fired through the suppressor 106, the suppressor 106 will not "over self-tighten" to a point where an average individual cannot remove the suppressor 106 by hand and without a tool (e.g., no more than 30 ft-lbs., or most often no more than 20 ft-lbs. of torque required to remove the suppressor 106). This is because the second plurality of discharge gas deflector openings 114 are specifically design and customized or tuned to self-tighten the suppressor 106 with sufficient torsional force to tighten the suppressor 106 upon each firing, but not sufficient torsional force to over-tighten the suppressor 106 beyond a maximum torque threshold value (e.g., 30 ft-lbs. or more). Most often the design can result in a maximum torque threshold or about 15 ft-lb. In most cases, the suppressor 106 can be threaded in place at about 0 ft-lb and during firing self-tightening occurs up to about 15 ft-lb of torque. Consequently, hand-tightening can be maintained regardless of the number of rounds (e.g., assuming the suppressor is allowed to cool to room temperature or at least below about 140° F.).

Further notably, the suppressor 106 (and the firearm system 100) can be devoid of a locking device or mechanism that locks the suppressor to an interface structure or a muzzle end, and that may require a tool or hand-actuation to unlock the suppressor. Thus, the suppressor 106 can be removed entirely or solely by a hand (while the other hand may be holding the firearm).

In one example, the interface structure 102 may not be used or needed. More specifically, the suppressor 106 can be directly threaded to the muzzle end of the firearm, so that when firing a projectile, discharge gases exiting through the openings 114 cause a torsional force to the suppressor 106 to self-tighten it directly to the firearm.

In one example shown best in FIG. 4, the deflector body 122 of the suppressor 106 can comprises a first tapered annular surface 130 interfaced to a second tapered annular surface 132 of the interface structure 102 to form a gas seal interface between the interface structure 102 and the suppressor 106. The tapered annular surfaces 130 and 132 are formed at an angle relative to the central axis X, and inwardly toward the distal end 112 of the suppressor. This "gas seal interface" assists to minimize or eliminate an amount of exhaust particles (e.g., carbon) that may tend to collect or disperse between the interface structure 102 and the suppressor 106, which can negatively affect operation and removal of the firearm system. For example, excessive carbon buildup can cause threads to seize, thus requiring tools and/or solvents to loosen the suppressor system.

In one example there is provided a method of removing the suppressor 106 from the interface structure 102. The method can comprise firing a plurality of projectiles from the firearm through the interface structure 102 and the suppressor 106. In response to firing at least one projectile, the suppressor 106 self-tightens to the interface structure 102 due to the torsional force exerted by exhaust gases exiting the plurality of discharge gas deflector openings 114. The method can comprise rotating the suppressor 106 relative to the interface structure 102 with at least one hand of a user to remove the suppressor 106 from the interface structure 102, such that removal of the suppressor 106 from the interface structure 102 is achieved without operating a locking mechanism (or a tool).

It is to be understood that the above-referenced embodiments are illustrative of the application for the principles of the present invention. Numerous modifications and alternative arrangements can be devised without departing from the spirit and scope of the present invention while the present invention has been shown in the drawings and described above in connection with the exemplary embodiment(s) of the invention. It will be apparent to those of ordinary skill in the art that numerous modifications can be made without departing from the principles and concepts of the invention as set forth in the claims.

What is claimed is:

1. A firearm accessory system coupleable to a firearm and that self-tightens in response to firing a projectile, comprising:

an interface structure threadably coupleable to a muzzle end of a firearm, the interface structure having a central axis that corresponds to a projectile pathway; and a suppressor threadably coupleable to the interface structure at a proximal end of the suppressor, wherein at least one of the interface structure and the suppressor comprises a plurality of discharge gas deflector openings, each discharge gas deflector opening formed at an angle relative to the central axis and to exhaust discharge gases out through a distal end of the suppressor, wherein the plurality of discharge gas deflector openings comprises a plurality of half-channels arranged in a helical manner about a peripheral area of the distal end of the suppressor, wherein the plurality of half-channels are arranged to surround a longitudinal central axis of the suppressor, and at least one of:

the plurality of half-channels surround a primary exhaust opening of the suppressor formed through the distal end of the suppressor, the plurality of half-channels each comprise a lead angle formed at an angle relative to the central axis, wherein the suppressor comprises right-handed threads operable to be right-hand threadably engaged to left-hand threads of the interface structure, whereby discharge gases flowing through the plurality of half-channels cause a counter-clockwise torsional force to tighten the suppressor in a counter-clockwise direction to the interface structure about the right-handed threads and the left-handed threads, and the plurality of half-channels are formed to exhaust secondary exhaust gases radially through the distal end of the suppressor, and wherein the primary exhaust opening is formed separate from the plurality of half-channels such that the primary exhaust opening exhausts primary exhaust gases generally axially out the primary exhaust opening, wherein in response to firing a projectile through the interface structure and the suppressor, discharge gases flowing through the plurality of discharge gas deflector openings cause a torsional force to tighten the respective one of the interface structure or the suppressor to the respective one of the muzzle end or the interface structure.

2. The firearm accessory system of claim 1, wherein the interface structure comprises a first plurality of discharge gas deflector openings of the plurality of discharge gas deflector openings and the suppressor comprises a second plurality of discharge gas deflector openings of the plurality of discharge gas deflector openings, wherein each of the discharge gas deflector openings of the first plurality is formed at a first angle relative to the central axis, and each of the discharge gas deflector openings of the second plurality is formed at a second angle relative to the central axis, wherein the first angle is different from the second angle.

3. The firearm accessory system of claim 2, wherein the first plurality of discharge gas deflector openings are formed to cause a first torsional force to tighten the interface structure to the muzzle end in a first direction, and wherein the second plurality of discharge gas deflector openings are formed to cause a second torsional force to tighten the suppressor to the interface structure in a second direction, wherein the first direction is opposite from the second direction.

4. The firearm accessory system of claim 1, wherein the plurality of discharge gas deflector openings are tuned to a size and shape such that the torsional force does not exceed a hand removal torque threshold associated with removing the suppressor from the interface structure, wherein the hand removal torque threshold is 30 ft-lbs.

5. The firearm accessory system of claim 1, wherein the suppressor includes a segregated gas pathway defined by central deflectors, wherein the segregated pathway leads to the plurality of discharge gas deflector openings, and wherein the segregated gas pathway is defined over at least 50 percent of a length of the suppressor.

6. The firearm accessory system of claim 1, wherein the plurality of discharge gas deflector openings comprises a plurality of internal deflectors formed about an inner chamber area of the suppressor.

7. The firearm accessory system of claim 1, wherein the plurality of discharge gas deflector openings comprises a plurality of angled slots formed through an outer surface portion of the interface structure, the plurality of angled slots situated around a longitudinal central axis of the suppressor.

8. The firearm accessory system of claim 7, wherein the plurality of angled slots comprises a first set of angled slots and a second set of angled slots axially off-set from each other along the central axis of the interface structure.

9. The firearm accessory system of claim 7, wherein the suppressor comprises a plurality of complementary angled slots formed at locations that correspond to the plurality of angled slots of the interface structure.

10. The firearm accessory system of claim 1, wherein the suppressor comprises a first tapered annular surface interfaceable to a second tapered annular surface of the interface structure to form a seal interface between the interface structure and the suppressor to minimize or eliminate an amount of exhaust particles collectable between the interface structure and the suppressor.

11. A firearm accessory system coupleable to a firearm that self-tightens in response to firing a projectile, comprising:

an interface structure threadably coupleable to a muzzle end of a firearm, the interface structure having a central axis that corresponds to a projectile pathway, wherein the interface structure comprises a first plurality of discharge gas deflector openings each formed at a first angle relative to the central axis and to facilitate passage of discharge gases; and a suppressor threadably coupleable to the interface structure at a proximal end of the suppressor, wherein the suppressor comprises a second plurality of discharge gas deflector openings each formed at a second angle relative to the central axis and to exhaust discharge gases out through a distal end of the suppressor, wherein, in response to firing a projectile through the interface structure and the suppressor, discharge gases flowing through the first plurality of discharge gas deflector openings causes a first torsional force to tighten the interface structure to the muzzle end of the firearm, and wherein discharge gases exhausting through the second plurality of discharge gas deflector openings causes a second torsional force to tighten the suppressor to the interface structure.

12. The firearm accessory system of claim 11, wherein the first plurality of discharge gas deflector openings are formed at the first angle to cause a first torsional force to tighten the interface structure to the muzzle end in a first direction, and wherein the second plurality of discharge gas deflector openings are formed at the second angle to cause a second torsional force to tighten the suppressor to the interface structure in a second direction, wherein the first angle is transverse relative to the second angle, and wherein the first direction is opposite from the second direction.

13. The firearm accessory system of claim 11, wherein the plurality of discharge gas deflector openings comprises a plurality of half-channels arranged in a helical manner about a peripheral area of the distal end of the suppressor, wherein the plurality of half-channels are arranged to surround a longitudinal central axis of the suppressor, wherein the plurality of half-channels surround a primary exhaust opening of the suppressor formed at the distal end of the suppressor, and wherein the suppressor comprises right-handed threads operable to be right-hand threadably engaged to left-hand threads of the interface structure, whereby discharge gases flowing through the plurality of half-channels cause a counter-clockwise torsional force to tighten the suppressor in a counter-clockwise direction to the interface structure about the right-handed threads and the left-handed threads.

14. The firearm accessory system of claim 11, wherein the second plurality of discharge gas deflector openings are tuned to a size and shape such that the torsional force does not exceed a hand removal torque threshold, and wherein the suppressor is devoid of a locking device such that the suppressor is removal by hand from the interface structure.

15. The firearm accessory system of claim 11, wherein the first plurality of discharge gas deflector openings comprises a plurality of angled slots formed through an outer surface portion of the interface structure, the plurality of angled slots situated around a longitudinal central axis of the suppressor, wherein the plurality of angled slots are formed in an opposite direction relative to the second plurality of discharge gas deflector openings of the suppressor.

16. A method of removing the suppressor as recited in claim 1 from the interface structure, the method comprising:

firing a plurality of projectiles from the firearm through the interface structure and the suppressor, whereby in response to firing at least one projectile, the suppressor self-tightens to the interface structure due to the torsional force exerted by exhaust gases exiting the plurality of discharge gas deflector openings; and rotating the suppressor relative to the interface structure with at least one hand of a user to remove the suppressor from the interface structure, wherein removal of the suppressor from the interface structure is achieved without operating a locking mechanism.

17. A firearm accessory system coupleable to a firearm and that self-tightens in response to firing a projectile, comprising:

an interface structure threadably coupleable to a muzzle end of a firearm, the interface structure having a central axis that corresponds to a projectile pathway; and a suppressor threadably coupleable to the interface structure at a proximal end of the suppressor, wherein at least one of the interface structure and the suppressor comprises a plurality of discharge gas deflector openings, each discharge gas deflector opening formed at an angle relative to the central axis and to exhaust discharge gases out through a distal end of the suppressor, wherein in response to firing a projectile through the interface structure and the suppressor, discharge gases flowing through the plurality of discharge gas deflector openings cause a torsional force to tighten the respective one of the interface structure or the suppressor to the respective one of the muzzle end or the interface structure and at least one of:

the suppressor comprises a first tapered annular surface interfaceable to a second tapered annular surface of the interface structure to form a seal interface between the interface structure and the suppressor to minimize or eliminate an amount of exhaust particles collectable between the interface structure and the suppressor, and the plurality of discharge gas deflector openings comprises a plurality of angled slots formed through an outer surface portion of the interface structure, the plurality of angled slots situated around a longitudinal central axis of the suppressor, wherein the plurality of angled slots comprises a first set of angled slots and a second set of angled slots axially off-set from each other along the central axis of the interface structure.

18. A firearm accessory system coupleable to a firearm and that self-tightens in response to firing a projectile, comprising:

an interface structure threadably coupleable to a muzzle end of a firearm, the interface structure having a central axis that corresponds to a projectile pathway; and a suppressor threadably coupleable to the interface structure at a proximal end of the suppressor, wherein at least one of the interface structure and the suppressor comprises a plurality of discharge gas deflector openings, each discharge gas deflector opening formed at an angle relative to the central axis and to exhaust discharge gases out through a distal end of the suppressor, wherein in response to firing a projectile through the interface structure and the suppressor, discharge gases flowing through the plurality of discharge gas deflector openings cause a torsional force to tighten the respective one of the interface structure or the suppressor to the respective one of the muzzle end or the interface structure and at least one of:

the interface structure comprises a first plurality of discharge gas deflector openings of the plurality of discharge gas deflector openings and the suppressor comprises a second plurality of discharge gas deflector openings of the plurality of discharge gas deflector openings, wherein each of the discharge gas deflector openings of the first plurality is formed at a first angle relative to the central axis, and each of the discharge gas deflector openings of the second plurality is formed at a second angle relative to the central axis, wherein the first angle is different from the second angle, wherein the first plurality of discharge gas deflector openings are formed to cause a first torsional force to tighten the interface structure to the muzzle end in a first direction, and wherein the second plurality of discharge gas deflector openings are formed to cause a second torsional force to tighten the suppressor to the interface structure in a second direction, wherein the first direction is opposite from the second direction, the suppressor includes a segregated gas pathway defined by central deflectors, wherein the segregated pathway leads to the plurality of discharge gas deflector openings, and wherein the segregated gas pathway is defined over at least 50 percent of a length of the suppressor, and the plurality of discharge gas deflector openings comprises a plurality of internal deflectors formed about an inner chamber area of the suppressor.

* * * * *